United States Patent [19]

Watanabe

[11] Patent Number: 5,035,223

[45] Date of Patent: Jul. 30, 1991

[54] FUEL INJECTION CONTROL SYSTEM FOR AN INTERNAL COMBUSTION ENGINE

[75] Inventor: Hideo Watanabe, Tokyo, Japan

[73] Assignee: Fuji Jukogyo Kabushiki Kaisha, Tokyo, Japan

[21] Appl. No.: 553,780

[22] Filed: Jul. 13, 1990

[30] Foreign Application Priority Data

Aug. 15, 1989 [JP] Japan ..... 1-210425

[51] Int. Cl.[5] ..... F02M 37/04

[52] U.S. Cl. ..... 123/459; 123/514; 123/457

[58] Field of Search ..... 123/514, 458, 463, 494, 123/497, 499, 357, 419, 457, 459

[56] References Cited

U.S. PATENT DOCUMENTS

| | | | |
|---|---|---|---|
| 3,568,646 | 3/1971 | Wehde | 123/458 |
| 3,844,263 | 10/1974 | Endo | 123/458 |
| 3,910,241 | 10/1975 | Fujisawa | 123/459 |
| 3,949,713 | 4/1976 | Rivere | 123/458 |
| 4,459,964 | 7/1984 | Straubel | 123/514 |
| 4,485,788 | 12/1984 | Hofbauer | 123/497 |
| 4,539,956 | 9/1985 | Hengel | 123/458 |
| 4,635,606 | 1/1987 | Koike | 123/459 |
| 4,683,864 | 8/1987 | Bucci | 123/514 |
| 4,800,859 | 1/1989 | Sagisaka | 123/459 |

FOREIGN PATENT DOCUMENTS

| | | | |
|---|---|---|---|
| 0075178 | 3/1983 | European Pat. Off. | 123/458 |
| 60-40756 | 3/1985 | Japan . | |
| 61-272447 | 12/1986 | Japan . | |

*Primary Examiner*—Carl Stuart Miller

*Attorney, Agent, or Firm*—Martin A. Farber

[57] ABSTRACT

A fuel injection system has a fuel injector provided for injecting fuel directly in a cylinder of an engine and a fuel pump for supplying the fuel to the fuel injector passing through a fuel supply passage. Two fuel return passages are provided for communicating the fuel supply passage with a fuel tank. A high pressure relief valve is provided in one of the fuel return passages and a low pressure relief valve is provided in the other fuel return passage. A changeover valve is provided for selectively connecting the fuel supply passage with one of the fuel return passages in accordance with load on the engine, thereby providing a high fuel pressure or a low fuel pressure in the fuel supply passage.

4 Claims, 7 Drawing Sheets

FUEL INJECTION CONTROL SYSTEM FOR AN INTERNAL COMBUSTION ENGINE

BACKGROUND OF THE INVENTION

The present invention relates to a system for controlling injection of fuel for an internal combustion engine with a direct fuel injection system, and more particularly to the system for controlling a fuel injection pulse width and fuel pressure and hence quantity of the fuel to be injected in accordance with operating conditions of the engine.

As the simplest method of producing scavenge air in a two-stroke cycle engine, a crankcase scavenging system is generally used. In an ordinary crankcase-scavenged two-stroke engine, vacuum is produced in an enclosed crankcase of the engine to induce fresh air when a piston ascends. When the piston descends, burned gas is discharged through an exhaust port while the fresh air in the crankcase is admitted into a cylinder, thereby scavenging the cylinder. However, at light engine load, since intake air quantity is small, the scavenging becomes insufficient, resulting in misfire and hence in an irregular engine operation. In addition, torque characteristics corresponding to the engine operating conditions becomes unstable, thereby consuming much oil. Fuel escapes without burning so that fuel consumption deteriorates and the amount of noxious exhaust gases increases. Moreover, at a heavy engine load, volume of the crankcase is insufficient for scavenging.

In order to solve such a problem, only air is delivered to the cylinder and fuel is injected directly to the cylinder by an injector after the exhaust port is closed. Such a direct fuel injection system may be a type where only high pressurized fuel is injected or a type where low pressurized fuel mixed with air is injected. In order to provide a charge stratification, it is preferable to inject only the fuel by high pressure, since the fuel can be injected in a short time and the injection timing can be set near the ignition timing, thereby restraining the diffusion of the fuel.

The fuel injection must have a large dynamic range so as to accurately inject a predetermined quantity of the fuel within a predetermined period at the high pressure. In addition, the injector must bear high pressure and temperature of the burned gas.

Japanese Patent Application Laid-Open 60-40756 discloses a fuel injection system for a four-stroke cycle engine having a simple relief valve and a pressure sensor provided instead of a pressure regulator. A quantity of fuel to be injected is quickly controlled in accordance with the change in fuel pressure by adjusting the fuel injection elapse time in dependency on the output signal of the fuel pressure sensor. However, since the fuel pressure is not controlled in the system, the dynamic range of the injector cannot be increased.

Japanese patent Application Laid-Open 61-272447 discloses a system where the fuel pressure which is the difference between the pressure of fuel supplied to the injector and the pressure in the intake passage is controlled so as to converge to a desired value. Several levels of the desired value are provided so that the quantity of injected fuel corresponding to the injection elapse time can be linearly controlled. However, since the fuel pressure is controlled in accordance with the intake pressure, the system is provided for injecting fuel at a relatively low pressure. Therefore, a large increase of the linearly controlled range can not be expected. Namely, assuming that the injection elapse time is constant, the quantity of the fuel injected from the injector is proportional to the value of the square root of the fuel pressure. Since the absolute value of the fuel pressure is inherently low in the fuel injection system, the change in the quantity of the injected fuel is small, even if the desired value for the fuel pressure is changed.

SUMMARY OF THE INVENTION

The object of the present invention is to provide a direct fuel injection control system for a two-stroke cycle engine in which pressure of fuel is controlled in accordance with engine load so that the quantity of the fuel to be injected can be widely varied with the engine load.

According to the present invention, there is provided a system for controlling fuel injection for an internal combustion engine having at least one cylinder, a fuel injector provided for injecting fuel directly in the cylinder and a fuel pump for supplying the fuel from a fuel tank to the fuel injector passing through a fuel supply passage.

The system comprises at least two fuel return passages communicating the fuel supply passage with the fuel tank, a changeover valve provided for selectively connecting the fuel supply passage with one of the fuel return passages, a high pressure relief valve provided in one of the fuel return passages for providing a high fuel pressure in the fuel supply passage, a low pressure relief valve provided in the other fuel return passage for providing a low fuel pressure in the fuel supply passage, detector means for detecting engine speed and load on the engine, fuel injection pulse width determining means responsive to the engine speed and load for determining pulse width of the fuel injection by the fuel injector, fuel pressure determining means responsive to the load for determining pressure of injected fuel and for producing a fuel pressure signal, first driving means responsive to the fuel pressure signal for operating the changeover valve for selecting one of the pressure relief valves for providing a predetermined fuel pressure, and second driving means for operating the fuel injector to inject the fuel at a predetermined pulse width.

In an aspect of the invention, the fuel pressure is determined so as to increase as the load increases.

The system further comprises a fuel pressure sensor for detecting a fuel pressure in the fuel supply passage, the fuel injection pulse width determining means is arranged to correct the predetermined pulse width in accordance with the difference between the predetermined fuel pressure and the fuel pressure detected by the fuel pressure sensor.

These and other objects and features of this invention will become understood from the following description with reference to the accompanying drawings.

DETAILED DESCRIPTION OF THE PREFERRED EMBODIMENTS

Figure 1A:
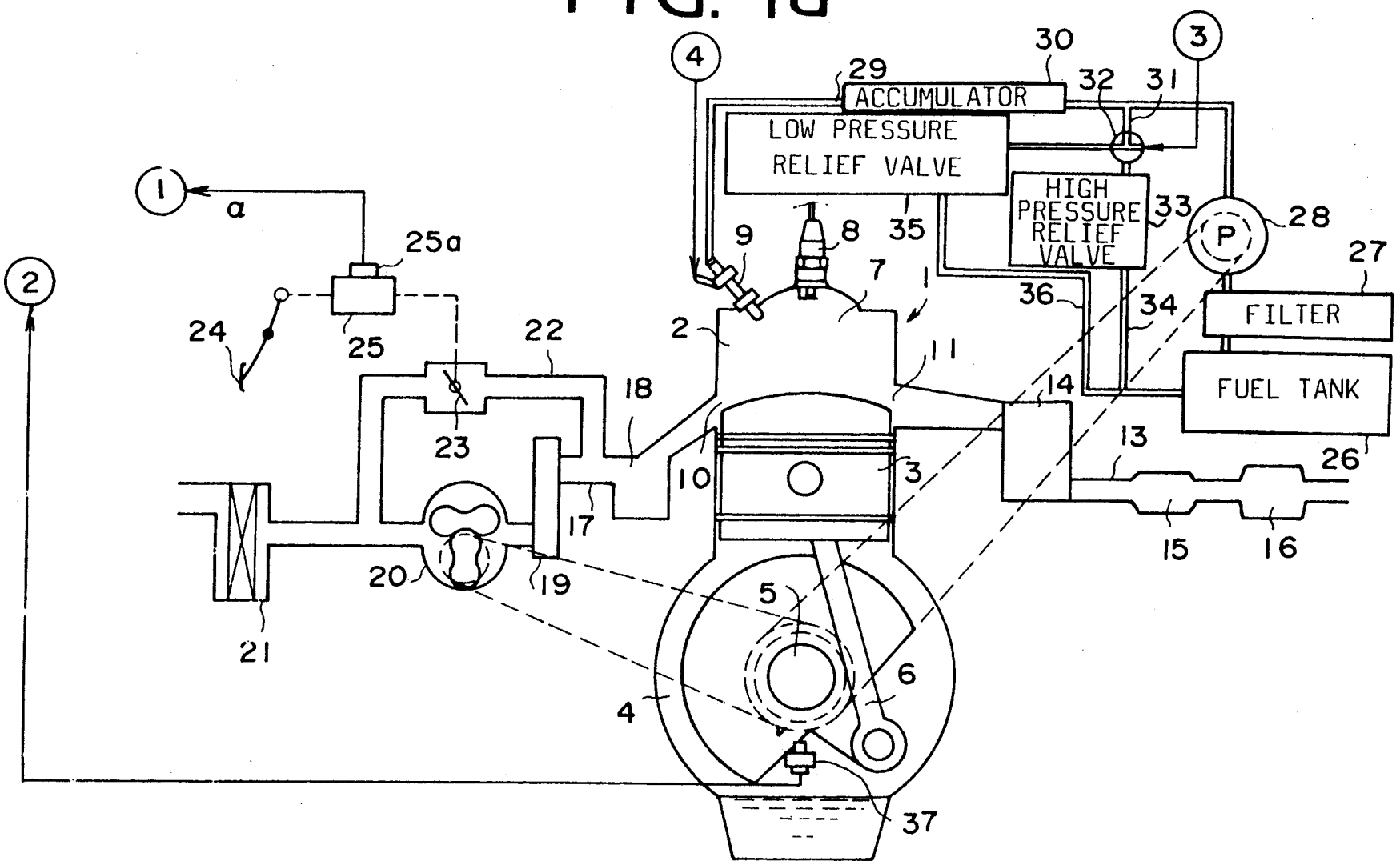
FIGS. 1*a* and 1*b* show a schematic diagram of a two-stroke cycle engine having a control system of the present invention.
Figure 1B:
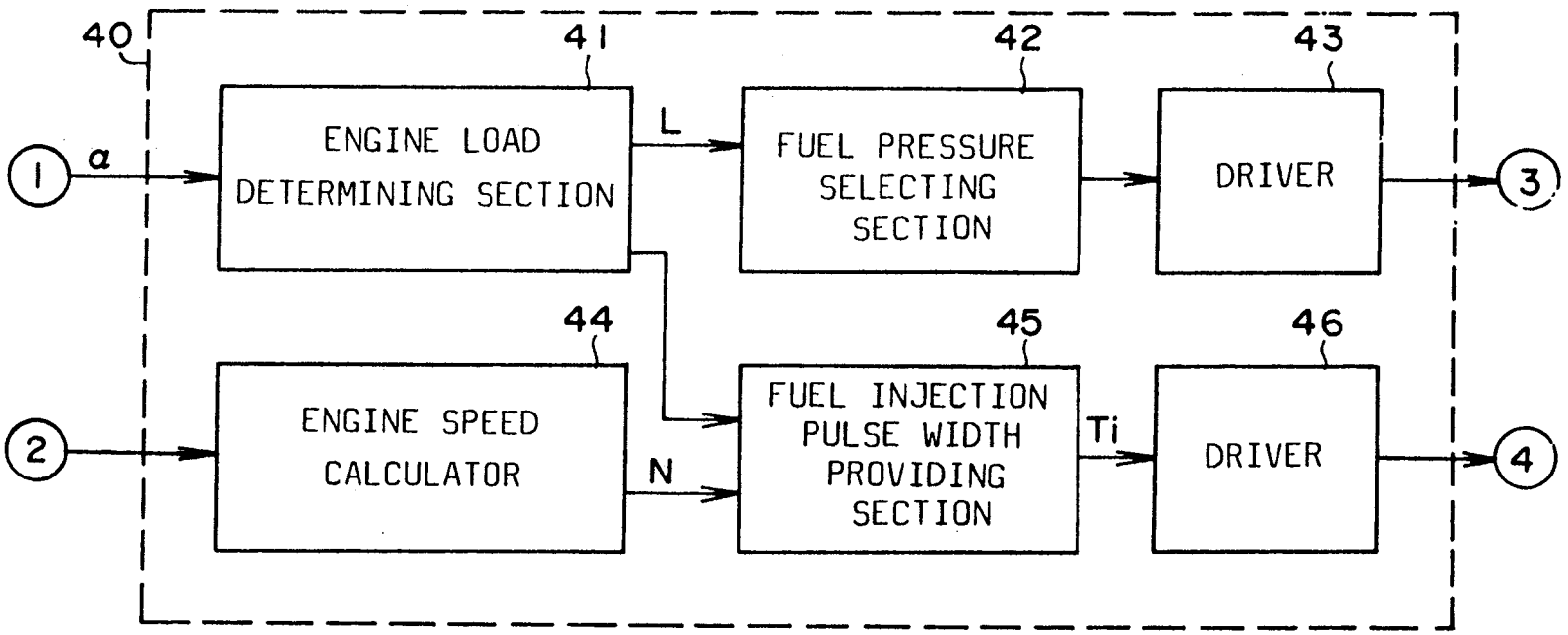

Referring to FIGS. 1*a* and 1*b*, a two-cycle engine 1 for a motor vehicle comprises a cylinder 2, a piston 3 provided in the cylinder 2, a connecting rod 6 connected with the piston 3 and a crankshaft 5 disposed in a crankcase 4.

In a wall of the cylinder 2, an exhaust port 11 and a scavenge port 10 are formed in 90 degrees angular disposition or opposing one another. The ports 10 and 11 are adapted to open at a predetermined timing with respect to a position of the piston 3.

A fuel injector 9 and a spark plug 8 are provided on a top of a combustion chamber 7 of the cylinder 2. The injector 9 is a type where a predetermined amount of fuel is injected at a high pressure. Fuel in a fuel tank 26 is supplied to the injector 9 through a fuel supply passage 29 having a filter 27, a high pressure pump 28 driven through a belt and pulley device by the crankshaft 5 and an accumulator 30. A fuel return passage 31 is communicated with the fuel supply passage 29. The fuel in the fuel supply passage 29 returns to the tank 26 through the return passage 31, a three-way change over valve 32 and through a high pressure return passage 34 having a high pressure relief valve 33 for providing higher pressure or a low pressure return passage 36 having a low pressure relief valve 35 for providing lower pressure. The three-way valve 32 is operated in accordance with a three-way valve operating signal from a control unit 40 to selectively connect the fuel passage 29 with the return passages 34 and 36. The high pressure relief valve 33 is arranged to relieve pressure beyond a predetermined higher value to provide a high fuel pressure in the fuel passage 29, and the low pressure relief valve 35 is arranged to provide a low fuel pressure.

The engine 1 is supplied with air through an air cleaner 21, a displacement type scavenge pump 20, an intercooler 19 for cooling scavenge air, an intake pipe 17 having a scavenge chamber 18 for absorbing scavenge pressure waves when the scavenge port 10 is opened or closed. A bypass 22 is provided around the scavenge pump 20 and the intercooler 19. The bypass 22 is provided with a control valve 23. Exhaust gas of the engine 1 is discharged passing through the exhaust port 11, an exhaust pipe 13 having a catalytic converter 14, an exhaust chamber 15 and a muffler 16.

The scavenge pump 20 is operatively connected to the crankshaft 5 through a transmitting device comprising an endless belt running over a crank pulley and a pump pulley. The scavenge pump 20 is driven by the crankshaft 5 through the transmitting device for producing a scavenge pressure. An accelerator pedal 24 is operatively connected with the control valve 23 through a valve controller 25. The opening degree of the control valve 23 is controlled by the controller 25 so as to be inversely proportional to the depressing degree of the accelerator pedal 24. Further, an engine speed sensor 37 and an accelerator pedal depressing degree sensor 25*a* of the valve controller are provided for determining engine operating conditions.

The control unit 40 has an engine load determining section 41 to which an accelerator pedal depressing degree $\alpha$ is fed, and an engine speed calculator 44 to which the output signal of the engine speed sensor 37 is applied. An engine load L determined at the engine load determining section 41 is applied to a fuel pressure selecting section 42. The three-way valve operating signal produced at the section 42 is fed to the three-way change-over valve 32 through a driver 43 so as to operate the valve 32, thereby controlling the pressure of the fuel at the pressure selected at the fuel pressure selecting section 42.

An engine speed N calculated at the engine speed calculator 44 and the engine load L are applied to a fuel injection pulse width (injection elapse time) providing section 45 having a fuel injection pulse width look-up table. The fuel injection pulse width look-up table stores a plurality of fuel injection pulse widths arranged in accordance with the engine load L and engine speed N. A fuel injection pulse width Ti retrieved from the look-up table is fed to the injector 9 through a driver 46.

The operation of the two-stroke cycle engine is described hereinafter.

The air supplied from the scavenge pump 20 and cooled at the intercooler 19 is returned to the inlet side of the scavenge pump 20 through the bypass 22. Since the opening degree of the control valve 23 is controlled to be inversely proportional to a depressing degree $\alpha$ of the accelerator pedal 24, when the depressing degree $\alpha$ of the accelerator pedal is small, the control valve 23 is largely opened. As a result, a large amount of air is returned to the inlet side of the scavenge pump 20. Thus, a small amount of air, which corresponds to the small accelerator pedal depressing degree, flows into the cylinder 2 for scavenging without causing pumping loss. As the depressing degree $\alpha$ increases, the quantity of fresh air forced into the cylinder 2 increases with the closing of the control valve 23.

When the piston 3 reaches a position close to the bottom dead center as shown in FIG. 1*a*, the scavenge port 10 opens as well as the exhaust port 11 so that intake air, quantity of which depends on the position of the accelerator pedal 24, is delivered by the scavenge pump 20 into the cylinder 2 through the intercooler 19 and the scavenge port 10. Consequently, burned gas in the cylinder 2 is scavenged so that fresh intake air is admitted therein in a short time. During the compression stroke, the piston 3 ascends, closing both ports 10 and 11. The fuel is injected from the injector 9 in accordance with the fuel injection pulse signal from the control unit 40 at a high pressure to form combustible mixture in the chamber 7. The mixture is swirled in the combustion chamber with the scavenging air and ignited by the spark plug 8 immediately before the top dead center. After explosion, the piston 3 descends for a power stroke. Accordingly, the exhaust port 11 is opened so that burned gas with high pressure in the cylinder 2 escapes. The piston 3 further descends, thereby returning to the afore-described intake stroke where the cylinder 2 is scavenged.

Figure 2:
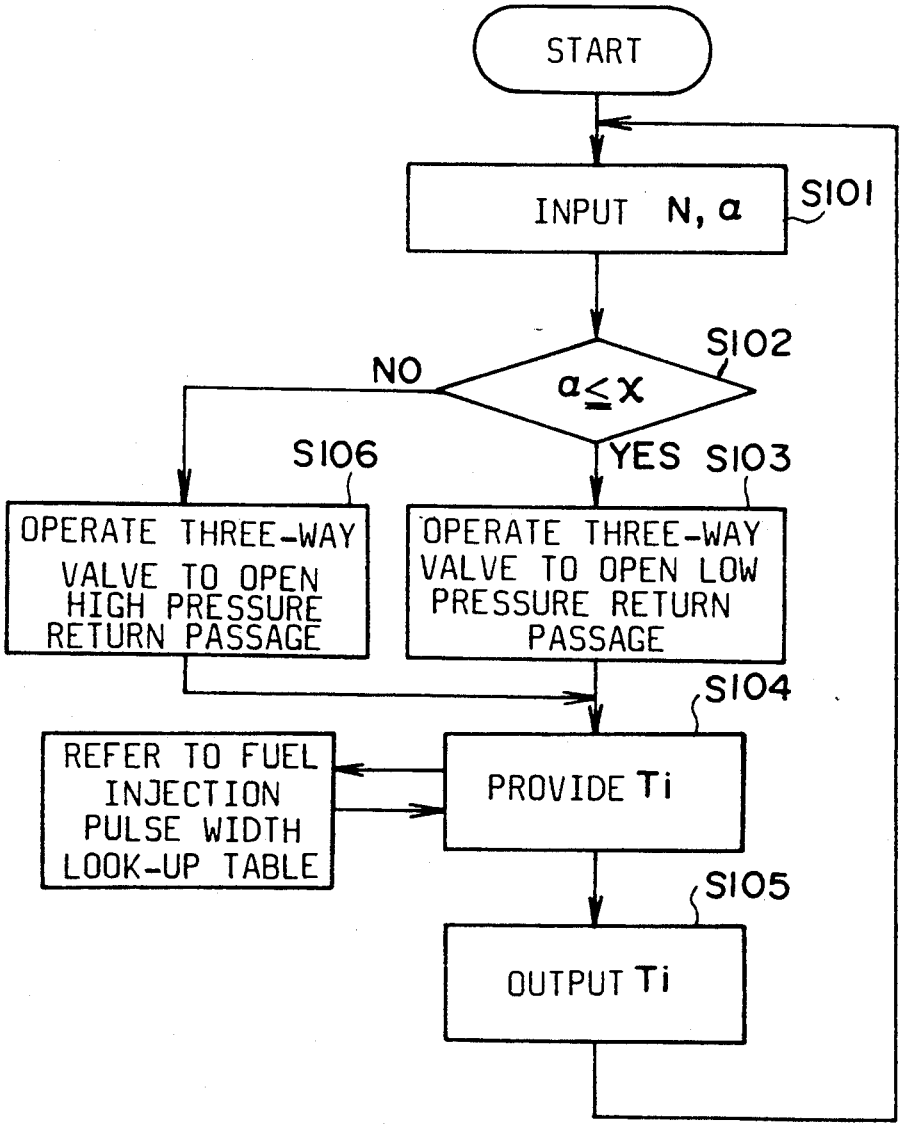
FIG. 2 is a flowchart showing an operation of the control system of the present invention.

The operation of the fuel injection system is described hereinafter with reference to the flowchart of FIG. 2.

When the engine 1 is operated, the engine speed N and the accelerator pedal depressing degree detected by the engine speed sensor 37 and the accelerator pedal depressing degree sensor 25*a*, respectively, are fed to the control unit 40 at a step S101. At a step S102, the accelerator pedal depressing degree $\alpha$ is compared with a predetermined reference value $\chi$ to determine the load on the engine 1.

Figure 3:
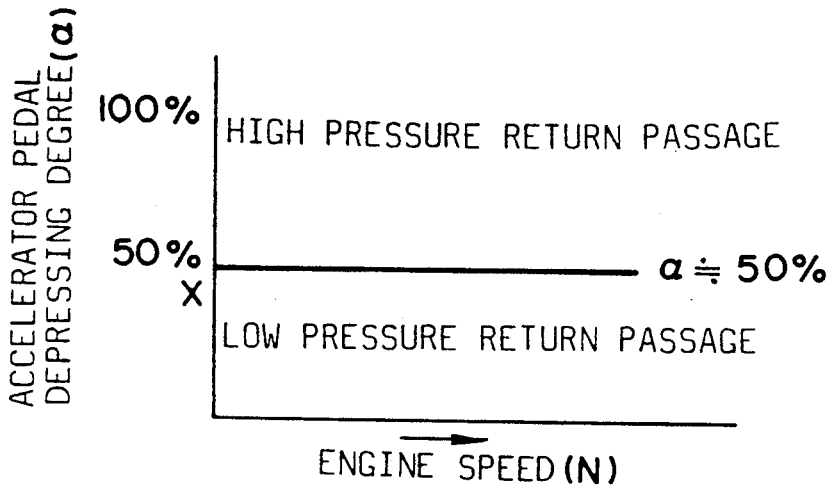
FIG. 3 is a graph showing operational ranges of a three-way valve with respect to accelerator pedal depressing degree.

As shown in FIG. 3, the reference value $\chi$ is about 50% of the depressing degree when the accelerator pedal is completely depressed. It is determined that the engine 1 is in a low load state when the accelerator pedal depressing degree $\alpha$ is smaller than $\chi$ ($\alpha \geqq \chi$), and in a high load state when larger than $\chi$ ($\alpha > \chi$).

When the accelerator pedal depressing degree $\alpha$ is equal to or smaller than $\chi$ ($\alpha \geqq \chi$), the program goes to a step S103 where the three-way valve 32 is operated to communicate the low pressure return passage 36 with the fuel passage 29. Thus, the fuel pressure is set to the low pressure by the low pressure relief valve 35. Thereafter, the program proceeds to a step S104 where the fuel injection pulse width Ti is retrieved from the look-up table in accordance with the engine load L and the engine speed N. The determined pulse width Ti is output at a step S105, thereby injecting fuel at the low fuel pressure during the pulse width Ti.

On the other hand, when it is determined at the step S102 that the accelerator pedal depressing degree $\alpha$ is larger than $\chi$, the program goes to a step S106 where the three-way valve 32 is operated to communicate the passage 29 with the high pressure return passage 34. Thus, at the step S105, the fuel is injected at a pulse width provided at the step S104 at the high fuel pressure regulated by the high pressure relief valve 33.

Figure 4:
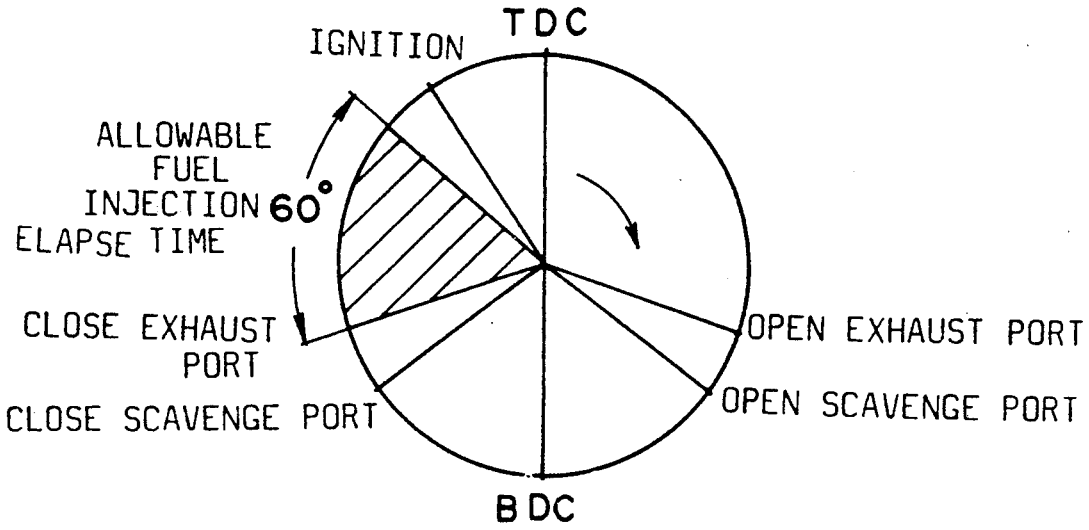
FIG. 4 is a diagram showing fuel injection timing.
Figure 5:
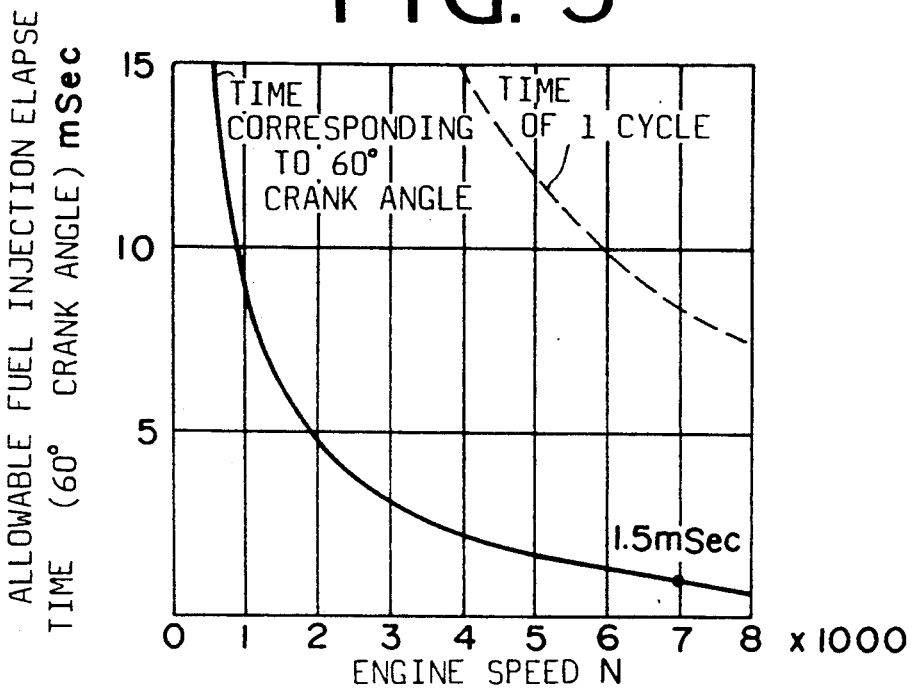
FIG. 5 is a graph showing a relationship between allowable injection elapse time and engine speed.

Referring to FIG. 4, in order to prevent the fuel from escaping through the exhaust port 11, the fuel must be injected after the exhaust port 11 is closed. Since it is necessary to provide a sufficient time for vaporizing the fuel in the cylinder, the fuel injection must be finished some time before the ignition. Therefore, the fuel is injected within an allowable injection elapse time corresponding to about 60 degrees crank angle as shown in FIG. 4. An allowable fuel injection elapse time decreases with the increase of the engine speed N as shown in FIG. 5. For example, the fuel injection elapse time is about 1.5 msec at the maximum engine speed of about 7000 rpm.

Figure 6:
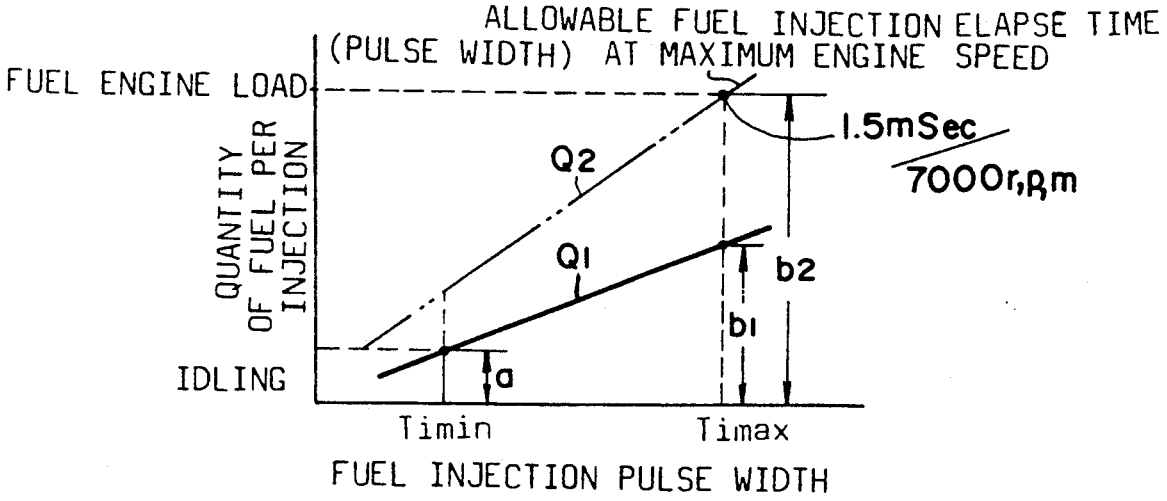
FIG. 6 is a graph showing a relationship between fuel pressure and quantity of fuel.

As shown in FIG. 6, the high pressure relief valve 33 provided in the high pressure return passage 34 is arranged to provide the high fuel pressure at which the fuel injection of a fuel injection pulse width Timax for full engine load is finished just in 1.5 msec. The low pressure relief valve 35 provided in the low pressure return passage 36 is adapted to provide the low fuel pressure at which the quantity of the fuel for idling the engine is injected at a minimum pulse width Timin. The pulse width Timin is the minimum pulse width at which the injector 9 can stably inject fuel.

Thus, when the three-way valve 32 is operated to increase the fuel pressure, the fuel injection characteristics of the injector 9 changes from a line $Q_1$ to a line $Q_2$. The dynamic range of the fuel injector 9 accordingly changes from $b_1/a$ to $b_2/a$. Since $b_2/a > b_1/a$, the dynamic range of the fuel injection is substantially increased, thereby enabling use of an injector having a small dynamic range.

Figure 7A:
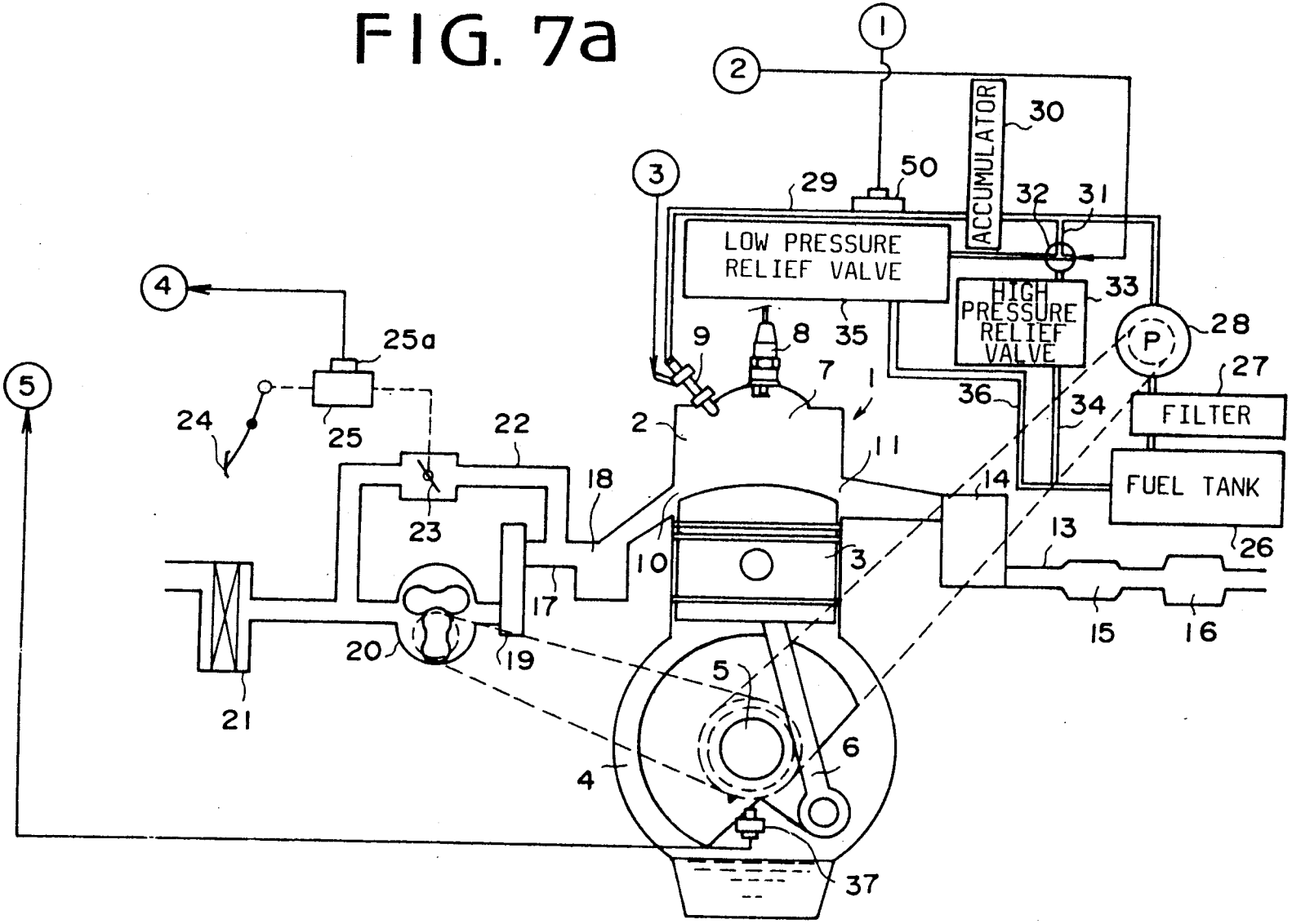
FIG. 7*a* and 7*b* show a schematic diagram of a two-stroke cycle engine according to a second embodiment of the present invention.
Figure 7B:
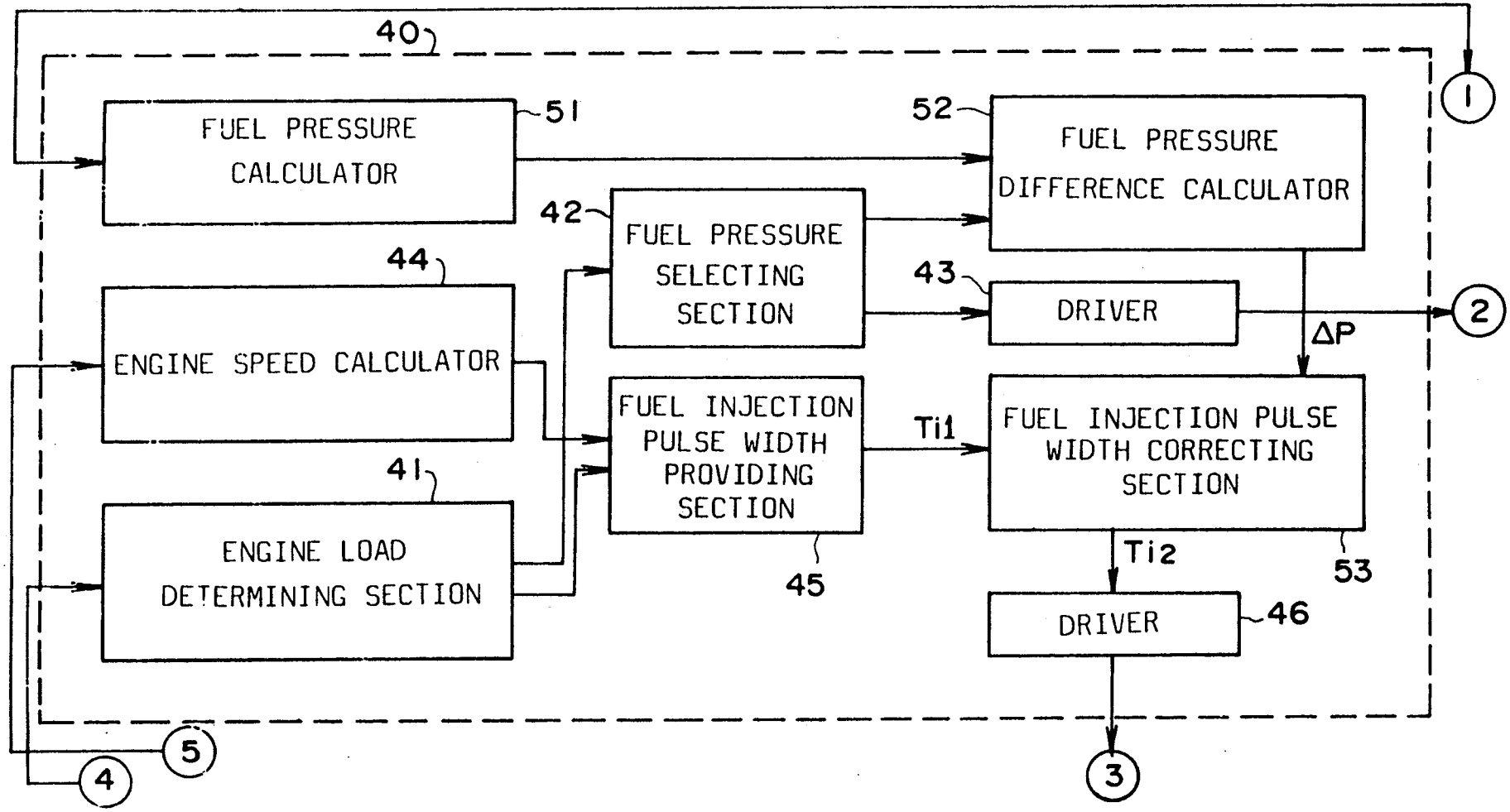

FIGS. 7*a* and 7*b* show the second embodiment of the present invention wherein a fuel pressure sensor 50 is provided in the fuel passage 29. The output signal of the fuel pressure sensor 50 is applied to a fuel pressure calculator 51 provided in the control unit 40. The fuel pressure calculated at the calculator 51 is applied to a fuel pressure difference calculator 52 where a pressure difference $\Delta P$ between the actual fuel pressure in the passage 29 calculated at the calculator 51 and the fuel pressure selected at the fuel pressure selecting section 42 in dependency on the engine load L is calculated. The difference $\Delta P$ is applied to a fuel injection pulse width correcting section 53 to which a fuel injection pulse width Ti1 retrieved from the look-up table in the fuel injection pulse width providing section 45 is fed. The pulse width Ti1 is corrected in accordance with the difference $\Delta P$ to obtain a corrected pulse width Ti2 which is applied to the injector 9 through the driver 46.

Thus, an appropriate quantity of fuel is injected when the three-way valve 32 is operated in a transient state of the engine, or when the high pressure relief valve 33 and low pressure relief valve 35 are deteriorated because of elapse of time.

The present invention may be modified to provide more than three levels of the fuel pressure instead of two levels, so that the differences of fuel pressures between the levels become smaller. Thus, the quantity of the fuel to be injected is accurately controlled in dependency on the selected fuel pressure.

The present invention may be also applied to a four-cycle engine.

In accordance with the present invention, the pressure of the fuel to be injected is controlled at two or more levels dependent on the engine load. Thus, the dynamic range of the fuel injector can be largely increased, so that even a fuel injector having a small dynamic range can be employed. Further, the present invention provides an inexpensive direct fuel injection system which increases the engine torque and improves fuel consumption.

While the presently preferred embodiments of the present invention have been shown and described, it is to be understood that these disclosures are for the purpose of illustration and that various changes and modifications may be made without departing from scope of the invention as set forth in the appended claims.

What is claimed is:

1. A system for controlling fuel injection for an internal combustion engine having at least one cylinder, a fuel injector provided for injecting fuel directly in the cylinder and a fuel pump for supplying the fuel from a fuel tank to the fuel injector passing through a fuel supply passage, the system comprising:

at least two fuel return passages communicating said fuel supply passage with said fuel tank;

a changeover valve provided in said passage for selectively connecting said fuel supply passage with one of said fuel return passages;

a high pressure relief valve provided in one of said fuel return passages for providing a high fuel pressure in said fuel supply passage;

a low pressure relief valve provided in the other fuel return passage for providing a low fuel pressure in said fuel supply passage;

detector means for detecting engine speed and load on the engine;

fuel injection pulse width determining means responsive to said engine speed and load for determining pulse width of the fuel injection by said fuel injector;

fuel pressure determining means responsive to said load for determining pressure of injected fuel and for producing a fuel pressure signal;

first driving means responsive to said fuel pressure signal for operating said changeover valve for selecting one of said pressure relief valves for providing the determined fuel pressure; and second driving means for operating the fuel injector to inject the fuel at said determined pulse width.

2. The system according to claim 1, wherein said detector means comprises an engine speed sensor, and a sensor for detecting a depression degree of an accelerator pedal for the engine.

3. The system according to claim 1, wherein the fuel pressure is determined so as to increase as the load increases.

4. The system according to claim 1, further comprising a fuel pressure sensor for detecting the fuel pressure in said fuel supply passage, and said fuel injection pulse width determining means being arranged to correct the determined pulse width in accordance with the difference between the determined fuel pressure and the fuel pressure detected by said fuel pressure sensor.

* * * * *